United States Patent [19]

Taylor

[11] 4,300,249

[45] Nov. 17, 1981

[54] CHAIR FOR NEUROLOGICALLY IMPAIRED PATIENTS

[76] Inventor: Francis H. Taylor, 218B South St., Eatontown, N.J. 07724

[21] Appl. No.: 133,905

[22] Filed: Mar. 25, 1980

[51] Int. Cl.[3] ..... A47K 17/00

[52] U.S. Cl. ..... 4/661; 4/478; 4/480; 297/460; 128/33; 128/70; 128/377

[58] Field of Search ..... 4/478, 479, 480, 444, 4/447; 297/460, 464; 128/33, 70, 377

[56] References Cited

U.S. PATENT DOCUMENTS

| | | | |
|---|---|---|---|
| 2,913,732 | 11/1959 | Jones | 4/480 |
| 2,970,638 | 2/1961 | Halter | 297/460 X |
| 3,165,355 | 1/1965 | Hitchcock, Jr. et al. | 297/460 X |
| 3,215,469 | 11/1965 | Wamsley | 4/480 X |
| 3,606,464 | 9/1971 | Arbuthnot | 297/460 |
| 3,815,586 | 6/1974 | Kazik | 128/70 |
| 3,858,937 | 1/1975 | Norris | 297/460 X |
| 4,207,879 | 6/1980 | Safadago et al. | 128/70 |

FOREIGN PATENT DOCUMENTS

| | | | |
|---|---|---|---|
| 1301595 | 12/1972 | United Kingdom | 297/464 |

*Primary Examiner*—Henry K. Artis

*Attorney, Agent, or Firm*—Carella, Bain, Gilfillan & Rhodes

[57] ABSTRACT

A contoured chair for use by neurologically impaired patients providing means for supporting such patients in a sitting position while preventing them from falling or slumping out of the chair due to the patient's inadequate muscular tone and control and consequent inability to independently maintain a sitting position. The chair comprises a contoured back portion for substantially matable engagement with the upper portion of the patient, recessed contoured portions for substantially matable engagement with the patient's elbows and upper arms, a contoured middle portion for substantially matable engagement with the patient's buttocks and upper legs, a contoured bottom leg portion for substantially matable engagement with the patient's lower legs, a foot rest portion for supporting the patient's feet, all said portions being hingedly and successively connected to each other. The chair further includes a frame for supporting the contoured body portions and spring means interposed between the frame and such portions for providing the patient with a feeling of motion and control. The chair is further provided with an inclined surface for the patient's use and for facilitating his rehabilitation by providing a surface upon which the patient may work with a workpiece. The chair is further provided with numerous other elements including hinged and movable arm rest portions, hinged and movable wrist portions, motor means for moving the chair horizontally and vertically as desired, and portable toilet means for enabling the patient to void without the necessity of removing the patient from the chair.

7 Claims, 2 Drawing Figures

CHAIR FOR NEUROLOGICALLY IMPAIRED PATIENTS

BACKGROUND OF THE INVENTION

1. Field of the Invention

This invention relates generally to the field of chairs. More specifically, this invention relates to chairs for use by handicapped, physically or neurologically impaired patients.

2. Description of the Prior Art

Chairs for use by handicapped or generally physically imparied patients are well known in the prior art. Notably, wheelchairs in a variety of shapes, styles and sizes are well known and of tremendous benefit in comforting and facilitating rehabilitation of certain groups of physically impaired patients including paraplegic or quadraplegic patients.

However, at least one group of physically impaired patients—those that are neurologically impaired—are not comforted and their rehabilitation is not facilitated by the variety of chairs available in the prior art. Neurologically impaired patients suffer from injury, disease or disorder of the brain or nervous system. While there may be a large variation in the severity of neurological disorders, in many cases neurologically impaired patients suffer from characteristic symptoms of relatively total loss of muscular control and motion, loss of speech, hearing and reasoning abilities and a consequent severe limitation of their ability to care for themselves.

For the many neurologically impaired patients who are unable to sit upright in a chair because of total loss of muscle tone and control, any efforts toward rehabilitation and recovery are hampered due to the fact that rehabilitation therapy must be carried out while the patient is lying down in bed. Not only is the rehabilitation therapy process slowed down because of the limitation placed upon available rehabilitation techniques because the patient must lie in bed, but also the process is slowed down because the patient in this position tends to see little if any visible or noticeable progress and thereby becomes discouraged from actively participating in rehabilitation efforts by assisting the therapist. It has been found in practice that those neurologically impaired patients that are able to become encouraged with the progress of rehabilitation tend to participate therein and thereby become rehabilitated more rapidly up to whatever level they are capable of (depending naturally upon the extent of damage to the brain or the nervous system).

For relatively severely neurologically impaired patients, there are generally three stages of rehabilitation. The first stage generally encompasses the task of getting the patient from a prone or supine position in bed to a sitting position (or reclined) in a chair. This stage must be accompanied by sufficient therapy to have the patient recover that muscle tone and control required to maintain a sitting position. The second stage of rehabilitation generally encompasses the tasks of recovering or improving the patient's speech ability and/or developing or increasing the patient's range of motion of various limbs (which may have been affected by the neurological disorder). This second stage may be carried out in a sitting or reclined position depending upon the particular therapy chosen by the therapist. The third stage generally comprises the task of getting the patients to walk, care for themselves and perform minimal tasks on command.

Naturally, the therapy involved in all three stages of rehabilitation depends heavily upon the therapist's talent and ability to guide the patient through a selected series of therapeutic exercies and programs. To the extent that the therapist is performing various terapeutic tasks alone and unaided by the patient, the therapist's task is made more difficult and the patient's progress is hampered.

Prior art chairs for use with physically impaired patients have been unsuitable for use with neurologically impaired patients. Consequently, the rehabilitation of neurologically impaired patients has been hambered due to the difficulty of completing the first stage of rehabilitation since the patient could not be brought to a sitting position until a certain predetermined level of muscular control and tone had been developed. It has been found through experience that the sooner a patient may be brought to a sitting or slightly reclined position (even before being able to maintain that position under his or her own power), the sooner that patient would develop the required muscular control and tone to maintain that position. However, prior art chairs generally for use with physically impaired patients have been unable to support the neurologically impaired patient sufficiently to maintain that patient in a sitting position. Neurologicaly impaired patients tend to slump down into and fall to the side or even fall out of chairs because they do not have sufficient muscular tone and control to maintain their sitting position in such chairs.

Because of the tendency of neurolocially impaired patients to fall over a slump when placed in a chair, rehabilitation of such patients has included strapping them into prior art chairs so that additional therapy could be continued even before the patient was fully able to maintain a sitting position under his or her own power. Strapping a patient invariably limits the patient's ability to even try to move and this further hampers rehabilitation—even a patient's initially futile attempts to move are beneficial to the rehabilitation process since the patient is using his or her own power. Strapping also increases the probability of patient injury and, equally seriously, prevents the patient from feeling in control of his or her environment thereby having a depressing and discouraging effect on the patient's outlook which invariably decreases the patient's will and desire to get well. Accordingly, there exists a need in the prior art for a chair for use with neurologically impaired patients to enable them to freely maintain a sitting position sooner than they would normally be able to develop sufficient muscular tone and control to do so on their own.

Because the prior art chairs have not enabled neurologically imparied patients to maintain a sitting position until relatively late in the rehabilitation process, the patient's total rehabilitation progress has been rather slow and discouraging. The sooner a patient may be brought through the first stage of rehabilitation and into the second stage, the sooner that patient will become encouraged with the rate of progress, which encouragement will further induce efforts on the part of the patient to participate in the rehabilitation process rather than rely totally upon the therapist. It has been found through experience that the more a patient directly participates in the therapy, the greater his feeling of security and confidence and the more rapidly the rehabilitation process is completed and to a greater level of accomplishment. Accordingly, there exists a need to provide a means for encouraging the patient's direct participation in his therapy rather than relying passively upon the therapist's exercises.

Furthermore, the therapy of neurologically impaired patients entails considerable efforts by the therapist (or several therapists simultaneously) to move the patient from one location to another. For example, the patient must be moved from the bed to a chair (as soon as the patient can be strapped in to maintain a sitting position). Then, the patient must be moved from the chair to and from a portable toilet seat as required. Then, obviously, the patient must be placed back into bed for sleep. Each time a patient must be moved, the probability of injury occurring to the therapist and the patient increases either due to the therapist straining himself or herself, or dropping or straining the patient somehow. Accordingly, there exists a need in the prior art to provide means for rehabilitating neurologically impaired patients while minimizing the number of times and extent to which a patient must be moved by a therapist.

As stated above, once a neurologically impaired patient has undergone a sufficient amount of therapy while in bed he will be able to more easily maintain or endure a sitting or reclining position at which time naturally he will be able to undergo a different series of necessary therapeutic exercises. For example, the sitting patient may be taught again how to write, speak, draw (by writing what he speaks) and eat. However, while the patient in this so-called second stage of rehabilitation may be exposed to these new series of therapeutic exercises, the patient must generally still undergo other therapy designed to increase his range of motion and in general to improve and increase his muscle tone and control thoughout the affected parts of his body. The prior art is totally devoid of any type of chair or apparatus wherein a neurologically impaired patient undergoing rehabilitation may be exposed to the requisite therapy while also being able to directly control his own motion thereby having an opportunity to use his own muscles and move under his own power. Accordingly, there exists a need in the prior art for a chair capable of permitting a neurologically impaired patient to exercise himself and feel that he is in control of his own environment.

SUMMARY OF THE INVENTION

This invention comprises a segmented and contoured chair for firmly supporting a neurologically impaired patient's body while he is in a sitting or reclined position in the chair. The chair comprises three hingedly connected contoured body portions for supporting a patient's body, (i.e., head, upper body) buttocks and upper legs, lower legs and feet), a neck brace portion for supporting the patient's neck and head, elbow recess portions for supporting the patient's back upper arm and elbow, movable armrest and wrist portions for moving or being moved by patient's arms and wrists respectively in an inclined table portion for facilitating the rehabilitation of writing and drawing abilities, and a footrest portion for supporting the patient's feet to assist in maintaining the patient within the chair.

The chair further comprises a frame to which the segmented contoured body portions are connected via springs for providing the patient with a feeling of motion and consequent control of his own environment. The chair still further comprises a movable inclined table for providing an inclined work surface for the patient's use while in a sitting or slightly reclined position. A portable toilet is included within the chair as well as motor means for moving the chair in any direction for limiting the number of times and extent to which a patient must be moved.

DETAILED DESCRIPTION OF THE PREFERRED EMBODIMENT

Figure 1:
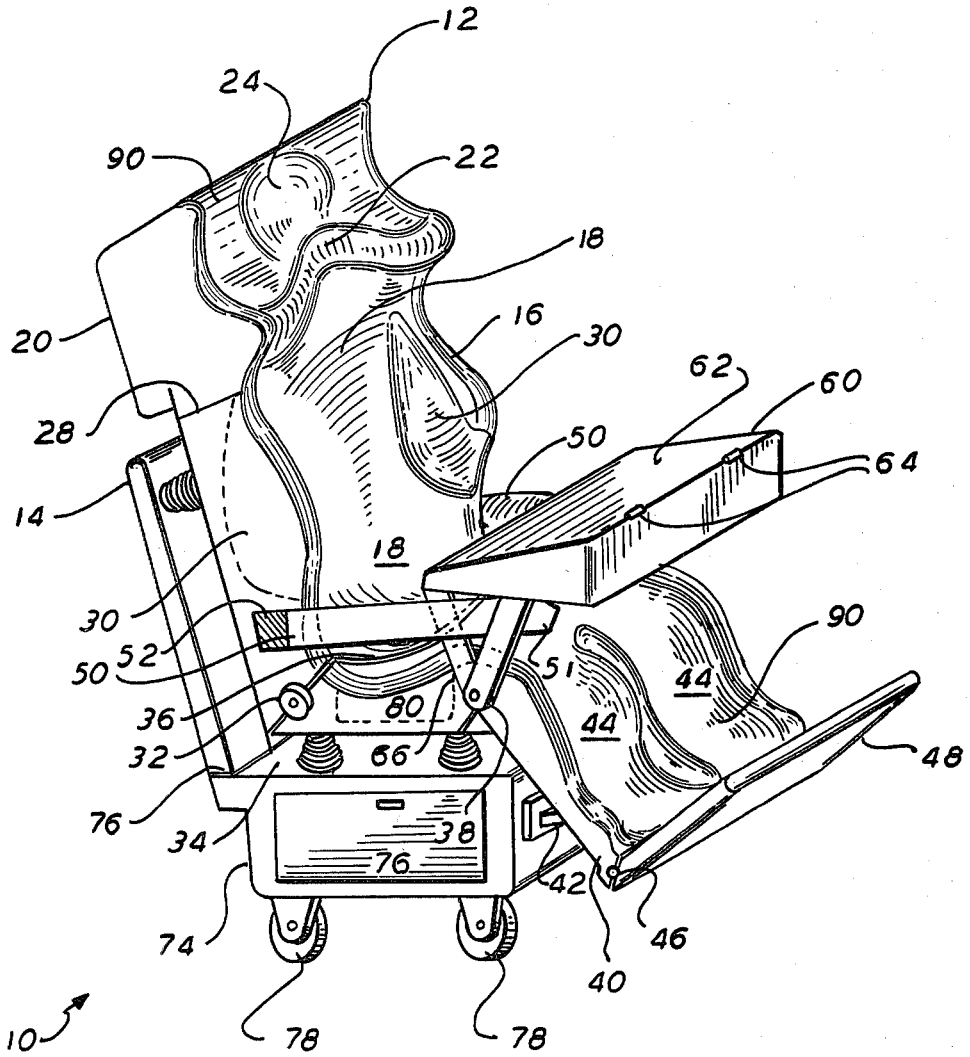
FIG. 1 is a perspective schematic drawing of the preferred embodiment of the invention.

Referring now to FIG. 1, there is shown a perspective schematic drawing of the preferred embodiment of the improved chair 10 for neurologically impaired patients.

Figure 2:
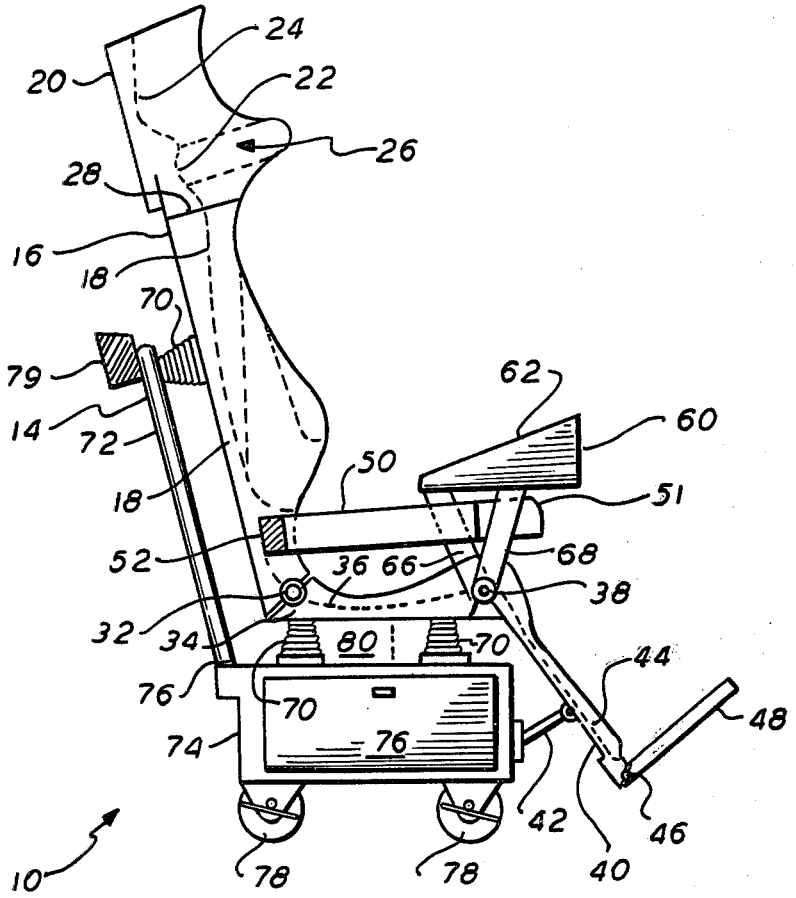
FIG. 2 is a side elevation schematic view of the invention shown in FIG. 1.

It is noted that chair 10 comprises chair portion 12 and frame portion 14. Referring now to FIG. 1 and FIG. 2, a side-elevation schematic view of improved chair 10, it is seen that chair portion 12 comprises a back portion 16 which is contoured at 18 for being capable of substantially matable engagement with a patient's back. Those skilled in the art will understand that the contours 18 need not necessarily be molded into back portion 16 but rather the contours 18 may be produced by partially molding appropriate contours into back portion 16 and then covering back portion 16 and those molded contours with, for example, some suitable flexible, resilient padding (not shown) which would inherently conform to the patient's back. In this way, chair 10 would be suitable for a wide variety of patients while offering all of them similar degrees of comfort and security.

Back portion 16 includes a neck and head portion 20 contoured at 22 for substantially matable engagment with the nape of the patient's neck and at 24 for substantially matable engagement with the patient's head. Contours 22 and 24 cooperate to assist the patient in maintaining his head in a desired position rather than having it move or roll uncontrollably due to an absence of muscular control of the neck. Contours 22 and 24 may be formed in portion 20 in a manner similar to the contours 18 as described above. Furthermore, while not shown, contours 22 may be included within a neck brace portion 26 which may, but does not necessarily have to, be integrally formed into portion 20. If, for example, neck brace portion 26 is formed so as to be removable from portion 20, this may be of benefit to certain neurologically impaired patients who are in need of some of the features of the chair 10 although they are not in need of a neck brace which may make them feel more restricted. For example, paraplegic patients with paralysis of the lower extremities may not need a neck brace 26.

Neck and head portion 20 may be hinged to totally removable from the remainder of back portion 16 so that neck and head portion 20 separates therefrom along line 28. This would provide an added advantage to chair 10 in that the grooming care and maintenance of patients would be facilitated since their hair could be washed while they were seated in the chair without requiring their removal. As stated above, limiting the number of times and extent to which patients must be moved is a desired feature not available in the prior art.

Back portion 16 is further provided with elbow and upper arm recesses 30 contoured for securing and holding the patient's upper arms and elbows and is hinged at 32 to seat portion 34 having contours 36 formed similarly to contours 18 for substantially matable engagement with the patient's buttocks and upper legs.

Seat portion 34 is hinged at 38 to lower leg portion 40 supported by an adjustable bracket 42 and contoured at 44 for substantially matable engagement with the patient's lower legs in a manner similar to other contours referred to up above. Lower leg portion 40 is hinged at 46 to a footrest portion 48 for supporting the bottom of patient's feet to prevent him from slipping out of the chair. Bracket 42 may be adjustable so that lower leg portion 40 may be placed at various angles for the comfort of the patient.

Chair portion 12 includes two armrests 50 for supporting the patient's arms and hands. Each armrest 50 has a wrist portion 51 hingedly secured thereto which may be moved for or by the patient (by means not shown) to facilitate therapy of the wrist and forearm muscles. Each armrest 50 is secured to back portion 16 at 52. By means not shown, each armrest 50 may be moved by the patient under his own power within a certain range of motion, such movement of armrests 50 being resisted by varying degrees of, for example, spring-like tension, in order to provide the patient with a relatively easy although therapeuticaly valuable type of exercise. Furthermore, armrests 50 may be provided with means (not shown) for automatically moving either one or both of them in response to a motor input of some kind so that the patient's arms may be exercised for the patient without his active participation.

Chair portion 12 is further provided with an inclined table 60 having an inclined surface 62 which may be opened about hinges 64. Adjustable and movable brackets 66 and 68 provide means for hingedly securing table 60 to chair portion 12 whereby the angle of incline of surface 62 may be changed in response to varying needs and degrees of proficiency of the patient. For example, more severely neurologically impaired patients will need a greater angle of incline because of their inability to manipulate writing tools or other things on a flat surface from a sitting position. Surface 62 provides an inclined working surface for the patient which is readily within the patient's view because of the incline and which surface is relatively close to the patient's arms resting on armrests 50 so that the patient with relatively little effort may move his arms and hands up to a workpiece on surface 62. Furthermore, the fact that surface 62 is hinged (with a storage space inside) provides an additional therapeutic exercise for the patient by requiring him to develop the coordination and strength necessary to lift the surface 62 and place articles into (or out of) table 60. By hinge means not shown table 60 may be moved to the side thereby providing an unrestricted path for placing the patient in the chair or removing his therefrom.

Chair portion 12 is mounted via coil springs 70 to frame 14 which has a back portion 72 and a bottom portion 74. The springs serve to provide the patient with a means for causing his own "rocking" or "bouncing" motion thereby affording some feeling of control of his environment and also thereby providing an additional exercise of the patient's muscles. The springs also cushion the impact of placing the patient in chair 10. Back portion 72 is hinged about point 76 so that back portion 16 may be placed at varying inclinations while maintaining springs 70 interposed between chair portion 12 and frame portion 14. The bottom portion 74 of frame 14 includes a storage compartment 76, wheels 78 and a motor (not shown) controlled by motor controls 79 (shown in FIG. 2) for powering wheels 78 for moving the chair in any desired horizontal direction and a motor (not shown) for elevating the chair portion 12 and frame portion 14 to desired heights thereby facilitating, for example, transferring the patient from a bed to chair 10 and visa-versa.

Chair 10 is further comprised of a portable toilet 80 installed appropriately beneath seat portion 34 whereby, by means of a movable trap flap or lid (not shown) in seat portion 34 the patient would be able to void without being moved from chair 10.

Inclusion of portable toilet 80 has several advantages in facilitating rehabilitation of neurologically impaired patients. Among these advantages is the elimination of a "foley" (bladder catheter) thus reducing probabilities of bladder infections and preventing bacteria growth, facilitating bladder control because it is not constantly drained by a catheter, eliminating discomfort to the patient and preventing skin breakdown.

Those skilled in the art will understand that surface 90 of chair portion 12 is preferably constructed of material which is relatively soft and comfortable to the patient since the patient must spend a fairly large amount of time in the chair. Furthermore, those skilled in the art will understand that all of the contours shown in chair portion 12 should be sufficiently deep enough to provide sufficient lateral support to the patient to prevent him from falling over to the side or slumping down or falling out of the chair. For this reason the contours 36 supporting the buttocks and upper legs of the patient must be sufficiently deep to permit seat 34 to support the majority of the patient's weight in order to cooperate with other parts of chair 10, for example, footrest 48, to prevent the patient from slipping over or down and out of the chair.

Those with skill in the art will realize that several changes and modifications may be made on the preferred embodiment of the invention disclosed herein without departing from the spirit and scope thereof.

What is claimed is:

1. A contoured chair for use by a neurologically impaired patient for facilitating rehabilitation therapy, comprising:

a contoured back portion for substantially matable engagement with the upper portion of said patient;

two recessed contoured portions affixed to said chair for substantially matable engagement with the back of each of the upper arms of said patient;

a contoured middle portion for substantially matable engagement with the buttocks and upper legs of said patient, said contoured middle portion hingedly secured to said back portion;

a contoured bottom leg portion for substantially matable engagement with the lower legs of said patient, said leg portion hingedly secured to said contoured middle portion;

a footrest portion hingedly secured to said leg portion for supporting said patient's feet;

a chair frame for supporting said back, middle and leg portions;

spring means interposed between said frame and said back and middle portions;

an inclined surface hingedly affixed to said middle portion for use by said patient;

two arm rest portions hingedly secured to said back portion for movement in response to said patient's efforts to move said arm rests;

means for moving said frame in a plurality of predetermined horizontal directions;

Reconsideration and allowance of this application is respectfully solicited in view of the foregoing amendment to the claims and the following remarks.

2. A chair in accordance with claim 1 further comprising a neck brace portion secured to said back portion for substantially matable engagement with the nape of the patient's neck.

3. A chair in accordance with claim 1 further comprising a wrist portion hingedly connected to each of said arm rest portions for supporting said patient's wrists.

4. A chair in accordance with claim 3 further comprising means for automatically moving a selected one or both of said wrist portions individually to thereby therapeutically exercise a selected one or both of said patient's wrists and forearms without the patient's assistance.

5. A chair in accordance with claims 1 or 3 further comprising means for automatically moving a selected one or both of said arms rests individually to thereby therapeutically exercise a selected one or both of said patient's arms without the patient's assistance.

6. A chair in accordance with claim 5 wherein said chair is further provided with means for enabling voiding while said patient is seated in said chair.

7. A chair in accordance with claim 6 further comprising means for elevating said chair to any desired elevation within a predetermined range of elevations.

* * * * *

UNITED STATES PATENT AND TRADEMARK OFFICE

CERTIFICATE OF CORRECTION

PATENT NO. : 4,300,249

DATED : NOVEMBER 17, 1981

INVENTOR(S) : FRANCES H. TAYLOR

It is certified that error appears in the above-identified patent and that said Letters Patent is hereby corrected as shown below:

Column 2, line 14, correct "hambered" to -- hampered --;
line 28, correct "Neurologicaly" to
-- Neurologically --;

Col. 4, line 57, "to" should be -- or --;

In the Claims:

Col. 7, line 5, ";" should be -- . --;
lines 6 to 9 should be deleted.

Signed and Sealed this

*Twelfth* Day of *February 1985*

[SEAL]

*Attest:*

DONALD J. QUIGG

*Attesting Officer* *Acting Commissioner of Patents and Trademarks*